US005318203A

United States Patent [19]

Iaia et al.

[11] Patent Number: 5,318,203

[45] Date of Patent: Jun. 7, 1994

[54] DUAL CHAMBER DISPENSER

[75] Inventors: Mark J. Iaia, Pearl River; Joseph E. Meenan, Pleasantville, both of N.Y.

[73] Assignee: Chesebrough-Pond's USA Co., Division of Conopco, Inc., Greenwich, Conn.

[21] Appl. No.: 86,287

[22] Filed: Jul. 1, 1993

[51] Int. Cl.[5] ..... B65D 35/22

[52] U.S. Cl. ..... 222/94

[58] Field of Search ..... 222/94, 129, 137, 145, 222/545, 546, 556

[56] References Cited

U.S. PATENT DOCUMENTS

| | | | |
|---|---|---|---|
| 3,166,221 | 1/1965 | Nielsen | 222/137 |
| 3,581,940 | 6/1971 | Cella | 222/94 |
| 3,729,553 | 4/1973 | Gold et al. | 222/94 X |
| 3,782,600 | 1/1974 | Columbus | 222/94 |
| 4,687,663 | 8/1987 | Schaeffer | 222/94 X |
| 4,723,671 | 2/1988 | Mears | 222/545 X |
| 4,964,539 | 10/1990 | Mueller | 222/145 X |
| 5,038,963 | 8/1991 | Pettengill et al. | 222/137 X |
| 5,137,178 | 8/1992 | Stokes et al. | 222/94 |
| 5,143,261 | 9/1992 | Drobish | 222/129 |

FOREIGN PATENT DOCUMENTS

| | | | |
|---|---|---|---|
| 3514134 | 10/1986 | Fed. Rep. of Germany | 222/94 |
| 3616207 | 11/1987 | Fed. Rep. of Germany | 222/94 |
| 3162248 | 7/1991 | Japan | 222/94 |
| 1103534 | 2/1968 | United Kingdom | 222/94 |
| 9105731 | 5/1991 | World Int. Prop. O. | 222/137 |

*Primary Examiner*—Kevin P. Shaver
*Attorney, Agent, or Firm*—Milton L. Honig

[57] ABSTRACT

A dual-chamber dispenser is provided that includes a cap having a dispensing base and a cover, and a pair of elongated hollow tubes attached to an underside of the dispensing base. At an upper dispensing end of each of the tubes is an exit orifice and a coupling mechanism for attachment to the underside of the dispensing base. The upper dispensing end is D-shaped in cross-section. At a lower sealing end of the hollow tube the cross-section is either round or oval. When filled with product, the lower ends of the pair of hollow tubes are crimped together to form a seal.

19 Claims, 3 Drawing Sheets

DUAL CHAMBER DISPENSER

BACKGROUND OF THE INVENTION

1. Field of the Invention

The invention concerns a dispenser for simultaneously delivering two compositions from separate chambers thereof.

2. The Related Art

Not all chemical ingredients are mutually compatible. Separation may be required because of chemical reactivity or physical incompatibility during storage. Certain health and beauty aids, cleaning compositions and dental formulas may be benefited by packaging that separates respective components of these products. Of particular concern have been dental products which require simultaneous delivery of mutually reactive sodium bicarbonate and hydrogen peroxide.

The art has described a number of packages that separate reactive components by placing their compositions in different chambers. Only at the point of use are these compositions combined. For instance, U.S. Pat. No. 5,020,694 (Pettengill) and U.S. Pat. No. 5,038,963 (Pettengill et al) describe rigid piston-type multi-cavity dispensing containers for simultaneous co-extrusion of two or more flowable materials in a predetermined proportion. These rigid containers have the advantage of relatively good control over the co-extrusion process. On the other hand, a considerable amount of plastic is involved in their construction. For environmental reasons, packaging with less plastic is sought.

Another suggestion in the art has been to utilize side-by-side collapsible tubes for toothpaste compositions. Representative of this technology is U.S. Pat. No. 4,487,757 (Kiozpeoplou), U.S. Pat. No. 4,687,663 (Schaeffer) and U.S. Pat. No. 4,964,539 (Mueller). Each of these disclosures describes a pair of tubes that have been crimped at an end distant from the product dispensing cap end. Actual attempts to crimp the ends of similar tube designs have resulted in improper seals. Not only were the resultant crimps difficult to form, but leakage was also noted in several instances.

Accordingly, it is an object of the present invention to provide a dual chamber dispenser utilizing less plastic than rigid packages while still providing good control over co-extrusion of the components.

Another object of the present invention is to provide a dual chamber dispenser utilizing a pair of flexible tubes whose ends can readily be crimped and whose crimp provides an adequate seal.

Other objects, features and advantages of this invention will become more apparent upon reference to the following detailed description and drawings illustrating a preferred embodiment thereof.

SUMMARY OF THE INVENTION

The object of the present invention is particularly achieved through use of a pair of elongated hollow tubes each of whose cross-section changes from a D-shape at a dispensing end to a round or oval shape at a sealing end. Each of the tubes at the dispensing end are D-shaped so that they can readily adjoin one another along a straight surface. On the other hand, at the sealing end distant from the dispensing opening, each tube has gradually transitioned into a round or oval shape to allow for ready crimping in a seal-effective manner.

Accordingly, a dual-chamber dispenser is provided including:

a cap having a dispensing base and a cover, the cover being hingedly attached to the base; and a pair of elongated hollow tubes attached to an underside of the dispensing base, each of the tubes at an upper end thereof having an exit orifice and a coupling device for attachment to the underside of the dispensing base, the upper end being D-shaped in cross-section and each of the tubes at a lower end thereof being of either round or oval cross-section and being crimped together with one another to seal the lower ends.

The elongated hollow tubes are manufactured by blow molding several different plastics to form a multi-layered wall. Transition from the D-shape to that of the round or the oval shape occurs approximately midway between the upper and lower ends of each hollow tube. The upper end of each tube is closed by a D-shaped surface defined by ends of a curvilinear edge intersecting a straight edge. The coupling device on the hollow tube is an undercut recess symmetrically traced below the D-shaped surface all along the curvilinear edge. The exit orifice is cut through the D-shaped surface at a point adjacent the straight edge. In order to allow the dispenser to be free-standing, the cover has an outer upper flat surface with a circumference no smaller than a largest circumference around both of the hollow tubes. Other embodiments may employ a cover with an outer circumference smaller than the largest circumference around both of the hollow tubes. Circumferentially projecting in a direction away from the upper flat surface is a skirt which surrounds an inner flat surface of the cover. Additionally, the cover includes a seal mechanism centered on the inner flat surface. This mechanism utilizes a circular outer wall protruding away from the inner flat surface and a pair of D-shaped hollow seal members each configured as a sector of a circle.

A hinge is provided to attach the cover to the base. This hinge is bisected by a plane separating one of the hollow tubes from the other.

On the dispensing base is an upper and lower surface. A circular spout with an opening bisected by a divider wall projects upward from the upper surface. A base skirt projects away from the spout and surrounds the lower surface of the base. A pair of hollow cylindrical nozzles rise from the base lower surface. Each of the nozzles communicates separately with a respective channel leading into the divided spout. Furthermore, each of the nozzles fits snugly into a respective one of the exit orifices of the hollow tubes. Cross-sectional dimensions of the respective nozzles and/or exit orifices for each pair may be of different opening size to allow adjustment for control of component flow, depending upon the flow characteristic of each component.

A series of projections spaced along a lower edge of the base skirt are arranged to engage the undercut recess of each of the hollow tubes. In a second embodiment, the coupling device employs a pair of semicircular projections protruding from the lower surface of the base downwardly and each partially surrounding a respective nozzle. Along a lower edge of each semicircular projection is an inwardly directed ledge engageable with a D-shaped undercut recess surrounding each exit orifice of the respective hollow tube.

The round or oval ends of the hollow tubes, subsequent to filling with product, are crimped together by a heat sealing machine. Such machines are well-known in the art.

BRIEF DESCRIPTION OF THE DRAWING

The above features, advantages and objects of the present invention will more fully be understood by consideration of the drawing describing an embodiment thereof in which.

DETAILED DESCRIPTION

Figure 1:
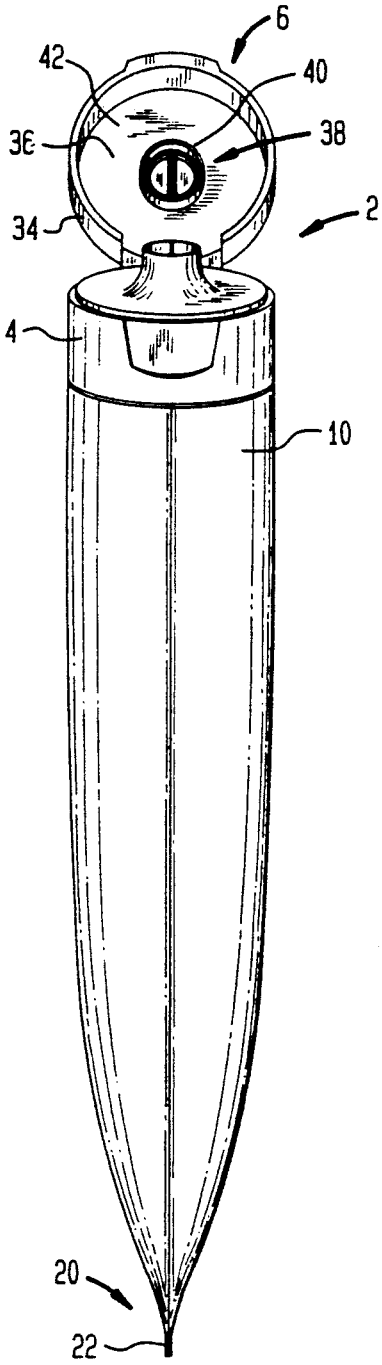
FIG. 1 is a perspective view of the dispenser with open cover.
Figure 2:
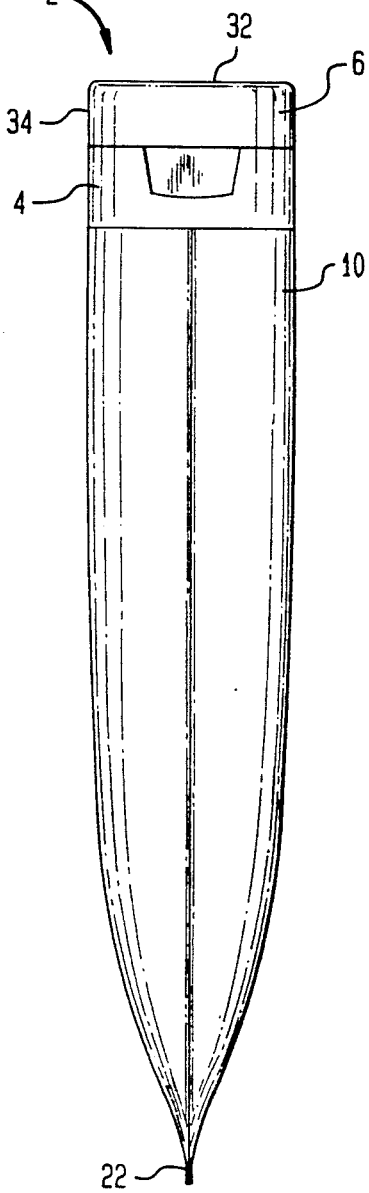
FIG. 2 is a front elevational view of the dispenser with closed cover.
Figure 3:
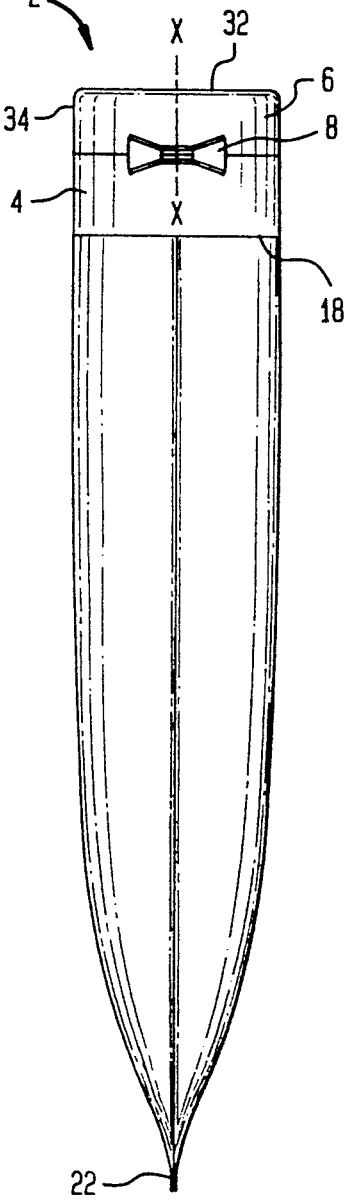
FIG. 3 is a rear elevational view of the dispenser with closed cover.
Figure 6:
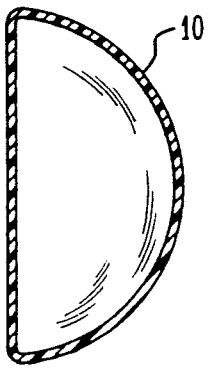
FIG. 6 is a cross-sectional view taken along line VI—VI of FIG. 5.

The dual-chamber dispenser of the present invention is best viewed in FIGS. 1–3 which illustrate a cap 2 including a dispensing base 4 and a cover 6. Hinge 8 flexibly attaches base 4 to cover 6. A pair of elongated hollow tubes 10 are joined to an underside of the dispensing base 4. An upper end 12 of each hollow tube 10 has an exit orifice 14. Each hollow tube 10 employs a coupling mechanism 16 for joining same to underside 18 of the dispensing base 4. Upper end 12 is D-shaped in cross-section as shown in FIG. 6. Lower end 20 of hollow tube 10 is either round or oval in cross-section. A crimp 22 seals together each of the lower ends of tubes 10.

FIG. 3 illustrates hinge 8 as being bisected by a plane X—X. This plane demarcates the planar separation between each of the hollow tubes 10.

Figure 4:
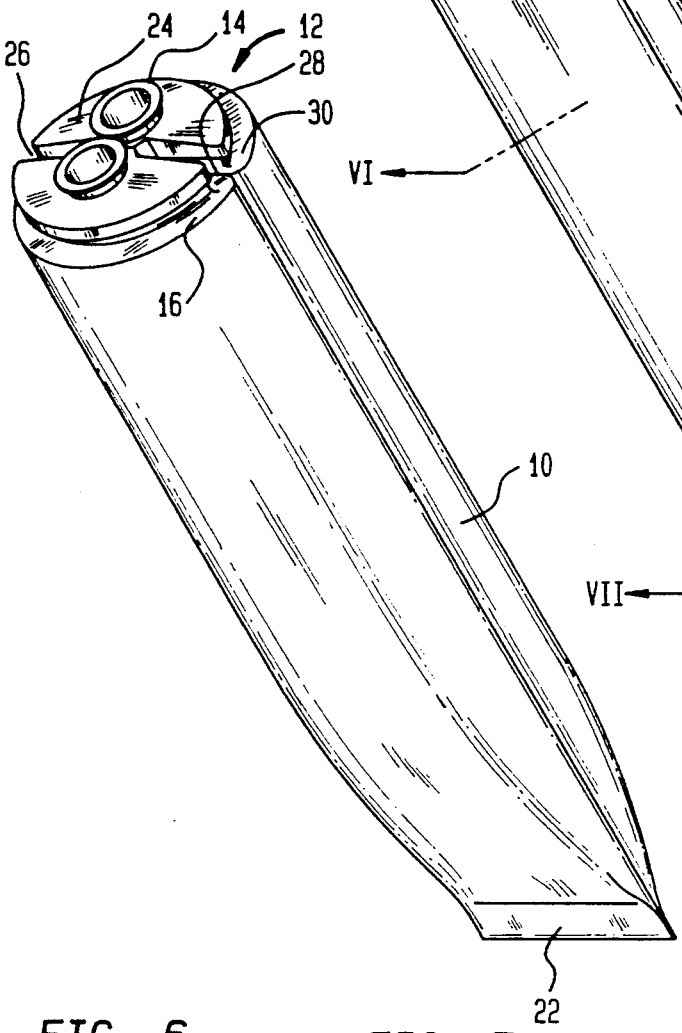
FIG. 4 is a perspective view of the pair of elongated hollow tubes positioned adjacent one another but without cap.

FIG. 4 reveals that upper end 12 of hollow tube 10 is closed by a D-shaped surface 24 defined by ends of a curvilinear edge 26 intersecting a straight edge 28. Coupling mechanism 16 is in the form of an undercut recess 30 symmetrically traced below the D-shaped surface 24 all along the curvilinear edge 26. Exit orifice 14 is positioned on surface 24 at a point adjacent straight edge 28. FIGS. 2–3 illustrate cover 6 as including an outer upper flat surface 32 with a circumference no smaller than a largest circumference around both of the hollow tubes 10. In a direction away from the upper flat surface 32 is a skirt 34 which surrounds inner flat surface 36 of cover 6. A seal mechanism 38 is centered on the inner flat surface 36. Included within the seal mechanism is a circular outer wall 40 protruding away from the inner flat surface 36 and a pair of D-shaped hollow seal members 42 each configured as a sector of a circle.

Figure 5:
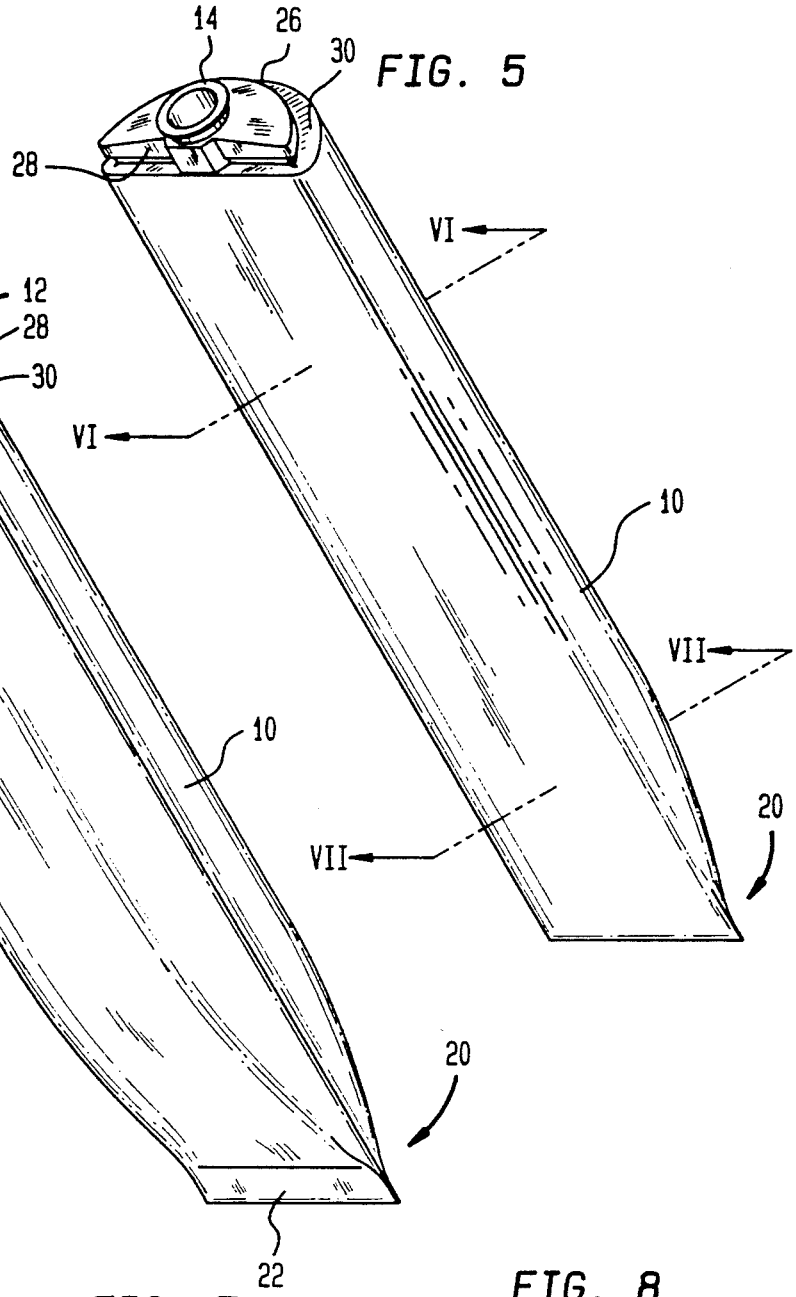
FIG. 5 is an elevational view of a single one of the elongated hollow tubes without cap and prior to being crimped.
Figure 7:
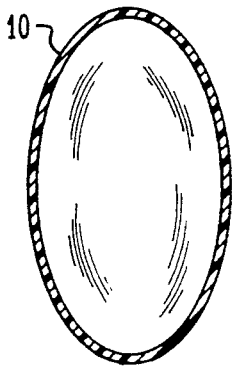
FIG. 7 is a cross-sectional view taken along line VII—VII of FIG. 5.

FIG. 5 illustrates a single hollow tube 10 prior to being joined with a second of the hollow tubes and cap, and prior to being crimped. FIG. 7 illustrates the round or oval shape of tube 10 near its lower end 20.

Figure 8:
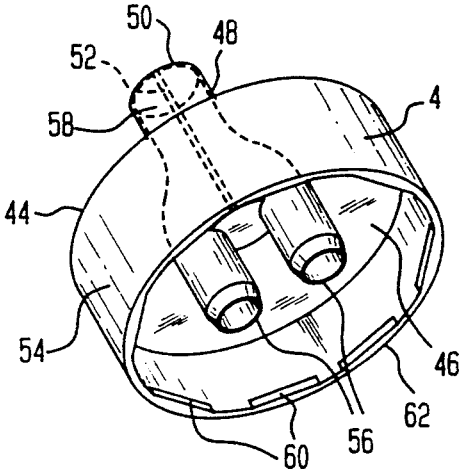
FIG. 8 is a perspective view of the dispensing base portion of the cap.

FIG. 8 provides a view of the dispensing base 4 which includes an upper surface 44 and a lower surface 46. A circular spout 48 projects upward from upper surface 44 and is provided with an opening 50 that is bisected by a divider wall 52. A base skirt 54 projects away from spout 48 and surrounds the lower surface 45. Projecting downward from lower surface 46 are a pair of hollow cylindrical nozzles 56. Each of nozzles 56 communicate separately with a respective channel 58 leading into the divided spout 48.

Hollow tubes 10 are fastened in a dual manner to cap 2. Firstly, a set of projections 60 are symmetrically positioned along a lower edge 62 of base skirt 54. These projections 60 engage recess 30 of tubes 10 in a fastening manner. Secondly, each of nozzles 56 tightly insert into a respective exit orifice 14 to further secure hollow tubes 10.

Figure 9:
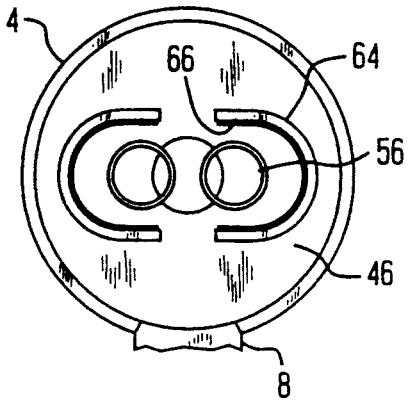
FIG. 9 is a bottom view of a second embodiment of the dispensing base portion of the cap.
Figure 10:
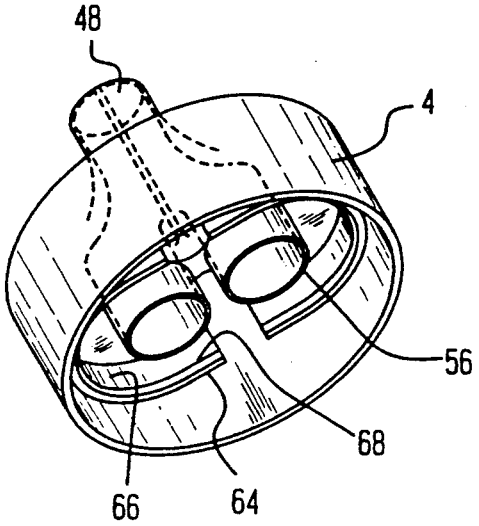
FIG. 10 is a perspective view of the second embodiment of the dispensing base portion of the cap.
Figure 11:
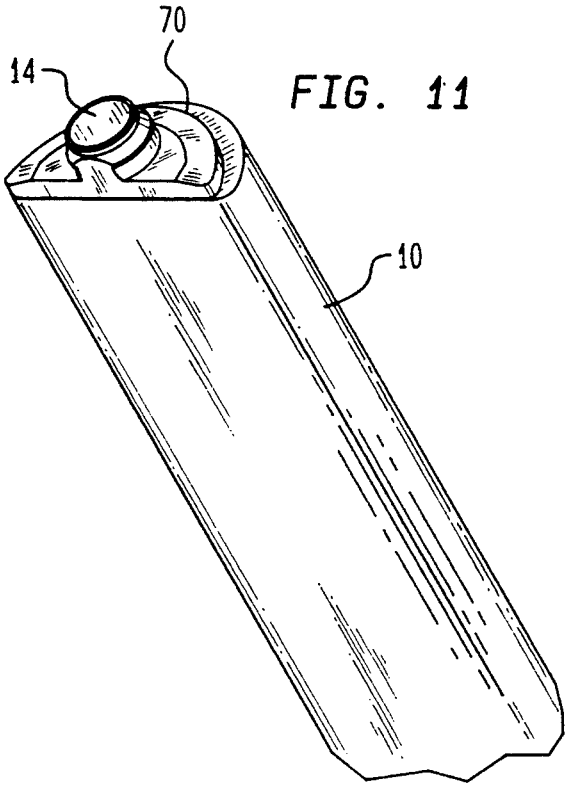
FIG. 11 is an elevational view of a second embodiment of a single one of the elongated hollow tubes without cap and prior to being crimped.

FIGS. 9 to 11 illustrate a second embodiment of the coupling arrangement for securing the hollow tube 10 to cap 2. In this embodiment, a pair of semicircular projections 64 extend from lower surface 46 of dispensing base 4 in a downward direction. Each projection 64 partially surrounds a respective nozzle 56. An inwardly directed ledge 66 is formed along a lower edge 68 of each projection 64. Ledge 66 is engageable with a D-shaped undercut recess 70 that surrounds each exit orifice 14 of the respective hollow tube 10.

The foregoing description illustrates only selected embodiments of the present invention, variations and modifications all being within the spirit and purview of this invention.

What is claimed is:

1. A dual-chamber dispenser comprising:

a cap having a dispensing base and a cover, the cover being hingedly attached to the base; and a pair of elongated hollow tubes attached to an underside of the dispensing base, each of the tubes at an upper end thereof having an exit orifice and a coupling means for attachment to the underside of the dispensing base, the upper end being D-shaped in cross-section, each of the hollow tubes gradually transitioning in cross-sectional shape till at a lower end thereof being of either round or oval cross-section and being crimped together with one another to seal the lower ends.

2. A dispenser according to claim 1, wherein a hinge attaches the cover to the base and is bisected by a plane separating one of the hollow tubes from the other.

3. A dispenser according to claim 1, wherein the cover has an outer upper flat surface with a circumference no smaller than a largest circumference around the hollow tubes in their attached position to the cap.

4. A dispenser according to claim 1, wherein the upper end of the hollow tube is closed by a D-shaped surface of smaller dimension than the D-shaped cross-section of the hollow tube and being defined by ends of a curvilinear edge intersecting a straight edge, the exit orifice cutting through the surface at a point adjacent the straight edge.

5. A dispenser according to claim 4, wherein the coupling means is a recess symmetrically traced below the D-shaped surface all along the curvilinear edge.

6. A dispenser according to claim 4, wherein the coupling means is a D-shaped recess surrounding the exit orifice of the hollow tube.

7. A dispenser according to claim 1, wherein the cover has an outer upper flat surface and a circumferential skirt projecting in a direction away from the upper flat surface.

8. A dispenser according to claim 7, wherein the cover has an inner flat surface surrounded by the skirt.

9. A dispenser according to claim 8, wherein the cover further comprises a seal means centered on the inner flat surface, the seal means including a circular outer wall protruding away from the inner flat surface and a pair of D-shaped hollow seal members each configured as a sector of a circle.

10. A dispenser according to claim 1, wherein the dispensing base has an upper and a lower surface, the base further comprising a circular spout with opening bisected by a divider wall projecting upward from the upper surface of the base and a base skirt projecting away from the spout and surrounding the lower surface of the base.

11. A dispenser according to claim 10, wherein the lower surface of the base includes a pair of hollow cylindrical nozzles rising therefrom, each of the nozzles communicating separately with a respective channel leading into the divided spout.

12. A dispenser according to claim 11, wherein each of the nozzles fits snugly into a respective one of the exit orifices of the hollow tube.

13. A dispenser according to claim 10, further comprising projections spacedly positioned along a lower edge of the base skirt.

14. A dispenser according to claim 11, further comprising a pair of semicircular projections extending downward from the lower surface of the dispensing base.

15. A dispenser according to claim 14, wherein the semicircular projections each partially surround a respective one of the pair of nozzles.

16. A dispenser according to claim 15, wherein the semicircular projection each include an inwardly directed ledge formed along a lower edge thereof, the ledge being engageable with a D-shaped recess on the hollow tube.

17. A dispenser according to claim 1 wherein the elongated hollow tubes are of plastic and unitarily-formed by blow molding.

18. An elongated hollow tube for use as a chamber in a dual-chamber dispenser that includes a cap with a dispensing base and a cover, the hollow tube comprising at an upper end thereof an exit orifice and a coupling means for attachment to the underside of a dispensing base, the upper end being D-shaped in cross-section and gradually transitioning in cross-sectional shape till achieving at a lower end of the tube either a round or oval cross-section.

19. An elongated hollow tube according to claim 18 wherein the hollow tube is plastic and unitarily-formed by blow molding.

* * * * *